US005894937A

United States Patent [19]

Schmidt

[11] Patent Number: 5,894,937

[45] Date of Patent: Apr. 20, 1999

[54] METHOD AND APPARATUS FOR PROCESSING BANK NOTES

[75] Inventor: Alfred Schmidt, Munich, Germany

[73] Assignee: Giesecke & Devrient GmbH, Munich, Germany

[21] Appl. No.: 08/547,024

[22] Filed: Oct. 23, 1995

[30] Foreign Application Priority Data

Oct. 21, 1994 [DE] Germany ..... P 44 37 722

[51] Int. Cl.[6] ..... B07C 5/00

[52] U.S. Cl. ..... 209/534; 271/187; 271/315

[58] Field of Search ..... 209/534; 271/315, 271/307, 301, 187

[56] References Cited

U.S. PATENT DOCUMENTS 4,980,543 12/1990 Hara et al ..... 209/534 X

FOREIGN PATENT DOCUMENTS 119814 6/1988 European Pat. Off. .

3232348 3/1984 Germany .

3412725 3/1989 Germany .

*Primary Examiner*—Donald W. Underwood

*Attorney, Agent, or Firm*—Andrus, Sceales, Starke & Sawall

[57] ABSTRACT

A method for automatic processing of sheet material, e.g. bank notes, wherein the bank notes are singled, transferred to a transport system, tested, and stacked in units of a predetermined piece number in so-called stackers by predetermined categories in accordance with the testing. The transfer of bank note to the transport system is interrupted as soon as the sensor unit ascertains that the predetermined piece number of a category is reached in a stacker. The bank notes of the same category already singled at this time are stored temporarily in the sorting plant until the stacker has processed the deposited predetermined piece number. The time for the interruption of singling is such that the first bank note singled again reaches the stacker only when the latter is ready for service again

13 Claims, 3 Drawing Sheets

METHOD AND APPARATUS FOR PROCESSING BANK NOTES

The present invention is directed to a method and apparatus for automatic processing or stacking of sheet material, such as bank notes, which works reliably even at high transport speeds.

In the inventive method and apparatus the bank notes are, as known in the art, singled, transferred to a transport system, tested, and stacked in units of a predetermined piece number in so-called stackers by predetermined categories in accordance with the testing. For each category one stacker is provided in the bank note sorting device. The basic idea of the invention is that the transfer of bank notes to the transport system is interrupted after the sensor device ascertains that the predetermined piece number of a category is reached. The bank notes of the same category already singled at this time are stored temporarily in the sorting plant until the stacker has processed the deposited predetermined piece number . The time for the interruption of singling should be such that the first bank note singled after the interruption of singling reaches the stacker only when the latter is ready for service again.

In a first embodiment of the invention the bank notes are stored temporarily in the stacker itself. The stacker is designed as a spiral pocket stacker, as described for example in DE-OS 32 32 348. The stacker includes a stacking wheel with spirally disposed pockets and a stripper. The necessary temporary storage of bank notes is performed within the stacking wheel. For example, if the bank notes are to be stacked in 100-note units it is necessary to perform a separation between the hundredth and the following note already located in the stacker. This separation is provided by a special stripper which can be withdrawn continuously from the spiral pocket stacker. It is withdrawn in such a way that the hundredth bank note is stripped out of the spiral pocket stacker but any further following bank notes remain in the spiral pocket stacker. The stripper must have returned to its working position when the bank notes remaining in the stacker reach the deposit position after a corresponding turn of the spiral pocket stacker.

The invention has the advantage that only one stacker is necessary per category of bank note. Since the stripper can be withdrawn relatively slowly in comparison to the bank note transport speed, the controlling forces to be expended for operating the stripper are comparatively low. The separation between individual notes in the bank note stream can therefore be performed accurately even at high transport speeds.

In a further embodiment of the invention the necessary temporary storage of bank notes can also be performed by a buffer path integrated in the transport path. The bank notes are introduced into the buffer path with the help of a usual switch and returned to the main transport system as son as the stacker is ready for service again.

Further advantages and developments of the invention will result from the subclaims as well as the description of embodiment examples with reference to the figures, in which:

FIG. 1 shows a schematic diagram of the invention,

FIG. 2A, 2B, 2C, and 2D show a function course of the first embodiment,

Figure 1:
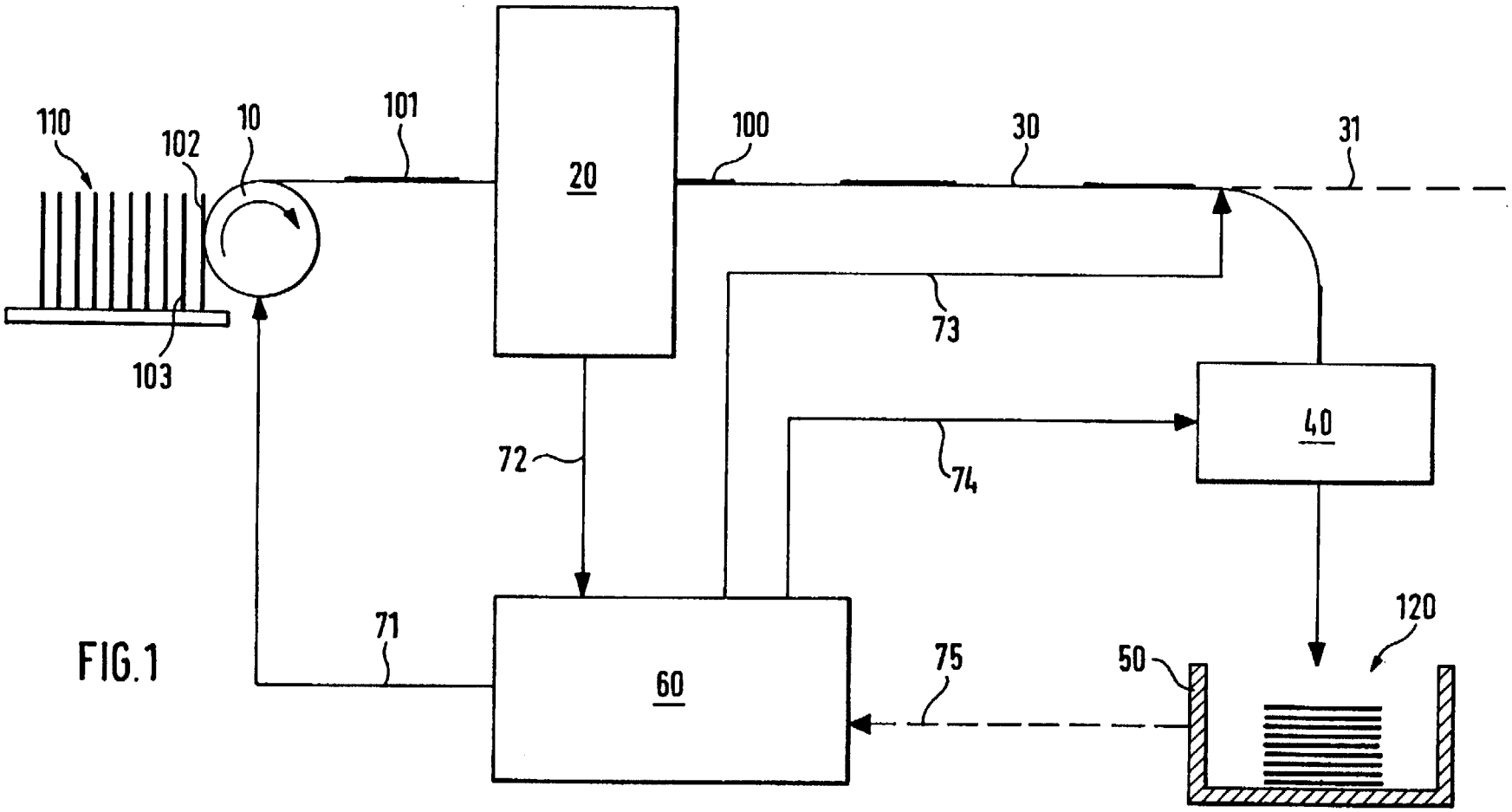

FIG. 1 shows a schematic diagram of an inventive apparatus. It consists of singler 10 into which one introduces at least one bank note stack 110 comprising a number of individual bank notes, including bank notes 102 and 103. Bank notes 100 and 101 show have already been removed from bank note stack 110 and transferred individually to transport path 30. With the help of singler 10 a continuous flow of individual bank notes thus comes about. Subsequent sensor device 20 is composed of one or more sensors for testing certain features of the bank notes. In accordance with the test result the bank notes are transported either via transport path 30 to stacker 50 or via transport path 31 to other further-processing units not shown here. Temporary store 40 is located in transport path 30, being in a position to store a number of bank notes, depending on the dimensions of temporary store 40, for a predetermined time. The flow of bank notes is coordinated by control device 60. It is in a position to receive information from the other components of the apparatus and to give them certain information or control commands.

For the bank notes of stack 110 to be processed, this stack is first introduced into singler 10 and singler 10 activated by control device 60 via data line 71. Bank note 100 will serve hers as an example for processing. It is first singled by singler 10 and transferred to transport system 30. Transport system 30 transports bank note 100 into sensor device 20, where bank note 100 is tested for certain features. Sensor device 20 transmits the test result via data line 72 to control device 60. The latter activates certain control devices in the transport system, such as switches, via data line 73 so that bank note 100 is fed to the proper further-processing unit in accordance with the test result. This may be e.g. stacker 50 for storing e.g. the bank notes of a certain denomination identified as authentic.

Control device 60 monitors the number of bank notes transferred to the individual further-processing devices. Bank note 100 is first e.g. tested by sensor device 20 and the test result transmitted via data line 72 to control device 60. If control device 60 ascertains that bank note 100 is intended for stacker 50 and this bank note reaches the predetermined number of a category of bank notes in stacker 50, it stops singler 10 via data line 71. Bank note 100 is thus the last bank note of stacking unit 120 of stacker 50 and is conveyed into stacker 50 due to corresponding control commands from control device 60 via data line 73. The bank notes already located in transport path 30 at the time the singler is stopped (bank note 101 here) or just being singled at this time (bank note 102) are transported to sensor device 20, tested there and fed to the proper further-processing units. If some or all of these tested bank notes are intended for stacker 50, they are first stored in temporary store 40 which is activated at a suitable time by control device 60.

At the end of a certain predetermined period of time singler 10 is reactivated by control device 60 via data line 71 and the singling process continued with bank note 103 of the stack. Alternatively, control device 60 can also receive information from stacker 50 via data line 75 which indicates its readiness for service. Due to this information, control device 60 then reactivates the singling process. To obtain a singling gap as short as possible, stacker 50 can already release its "ready" information before the time of its actual readiness so that the next possible bank note reaches stacker 50 at the time of its actual readiness. Simultaneously with the activation of the singling process, temporary store 40 receives a control command via data line 74 for emptying the bank notes stored in it into stacker 50.

During the singling gap resulting from the stop of the singler no further bank notes are thus deposited in stacker 50, so that there is enough time to empty stacking unit 120 from stacker 50 or to perform a further-processing operation in stacker 50.

A separate description of singler 10, sensor device 20 and transport path 30 is deemed unnecessary since these components and their operation are well known.

Figure 2A:
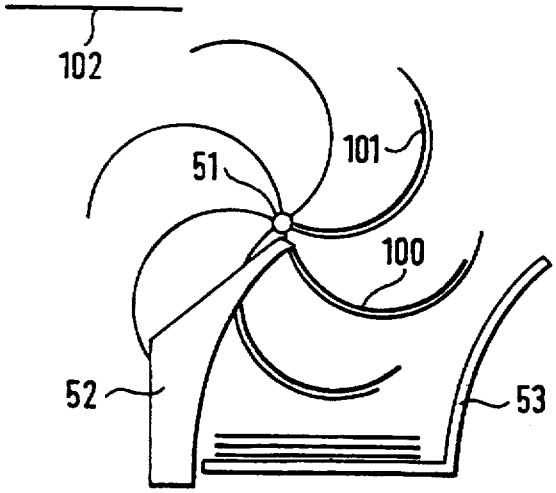
Figure 2B:
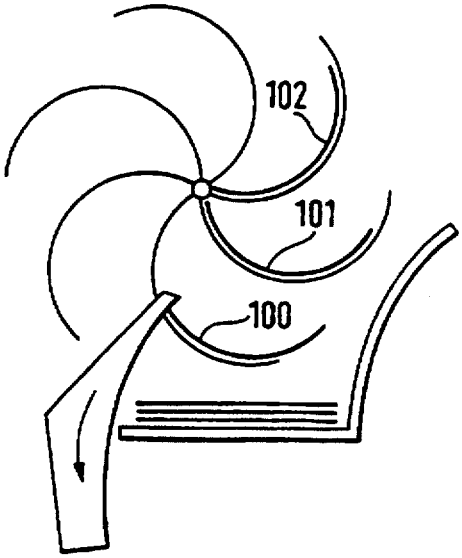
Figure 2C:
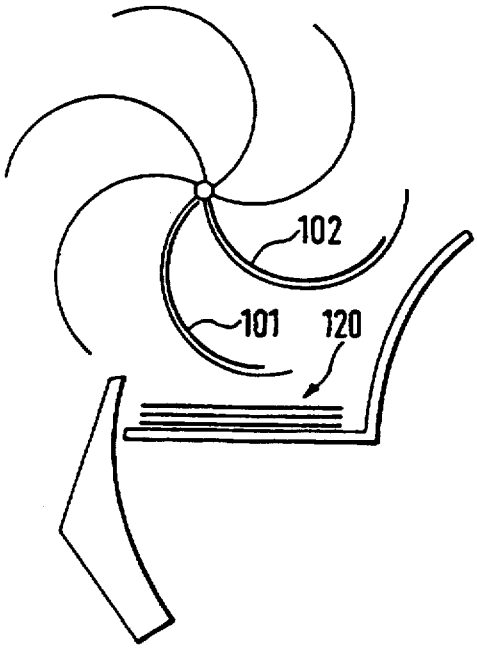
Figure 2D:
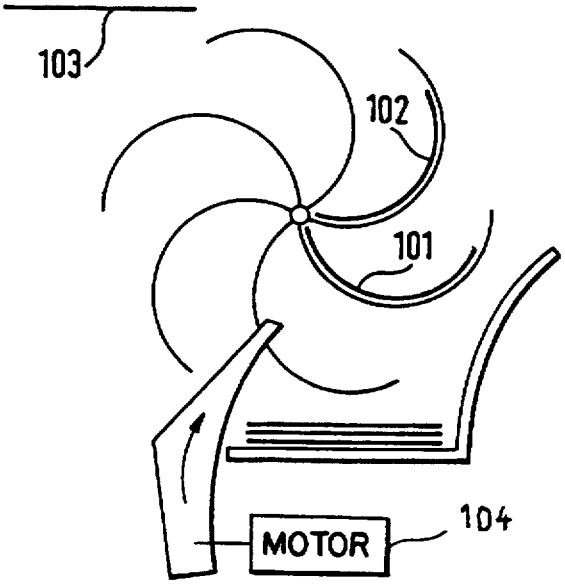
Figure 3:
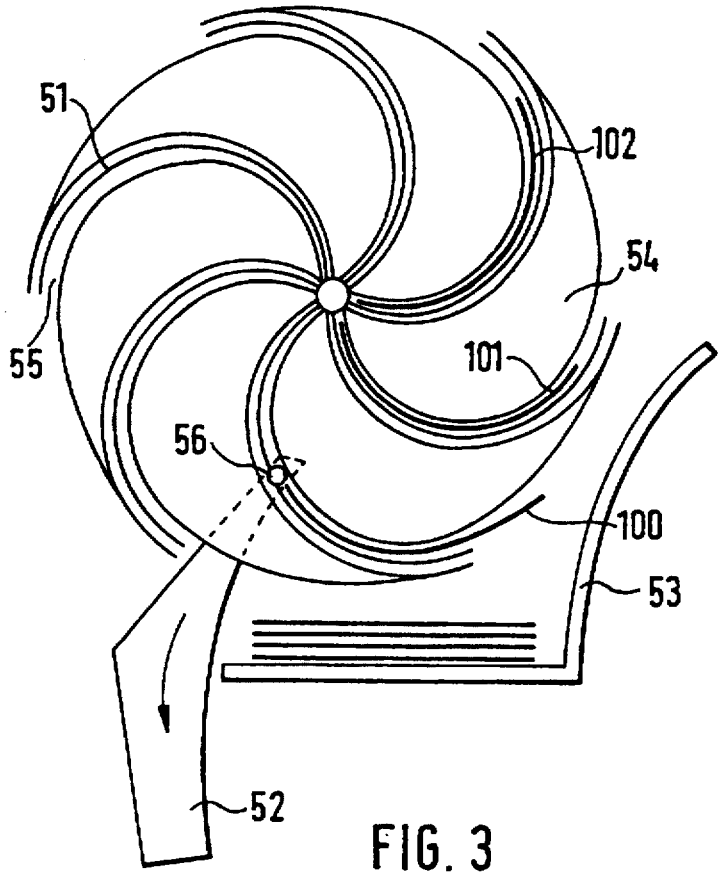
FIG. 3 shows a schematic diagram of the first embodiment with a contour disk.
Figure 4:
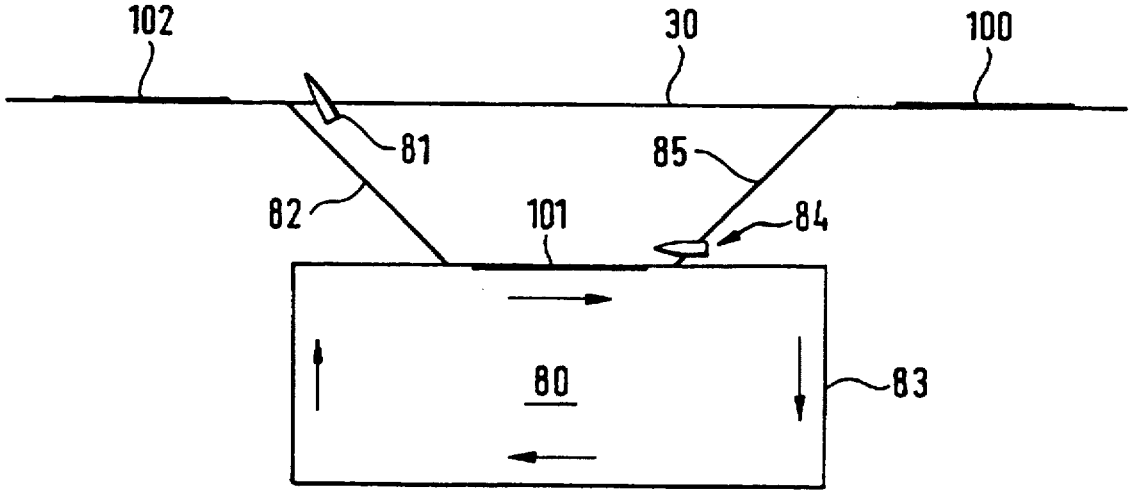
FIG. 4 shows a schematic diagram of the second embodiment.

FIGS. 2, 3 and 4 each show special embodiments of stacker 50 and temporary store 40. The peculiarity of the first embodiment is that both stacking of the bank notes and temporary storage during the singling gap are performed in stacker 50. The stacker shown in a very schematic form in FIG. 2 consists of stacking wheel 51 with spirally disposed pockets, stripper 52 and stacking pocket 53. One peculiarity here is the movable design of stripper 52, so that the latter can be moved out of stacking wheel 51 or moved into stacking wheel 51. Temporary store 40 is realized by means of stacking wheel 51 and stripper 52 of stacker 50. The cooperation of the individual components will be described more closely in the following with reference to FIG. 2.

In normal stacking operation stripper 52 is located in a position where it can strip out the sheets located in the stacking wheel. This position is shown in FIG. 2A and referred to in the following as the working position. The individual bank notes are transported by transport path 30 directly into stacking wheel 51. Stripper 52 grasps each bank note at the edge facing the center of stacking wheel 51, and strips these bank notes out of stacking wheel 51 so that they are stacked in stacking pocket 53.

If the test result of bank note 100 for stacker 50 is now reported to control device 60, the latter stops singler 10. FIG. 2B shows how stripper 52 strips bank note 100 out of stacking wheel 51 while the stripper is being moved out of stacking wheel 51. Bank notes 101 and 102 which were already located in transport path 30 when the singler was stopped are likewise assigned to stacker 50 according to the example shown. They are therefore transported by transport path 30 into stacking wheel 51. Bank notes 101 and 102 remain in stacking wheel 51 while stripper 52 is moved out.

FIG. 2C shows stripper 52 in its moved-out position. Bank notes 101 and 102 remain in stacking wheel 51 for one or more turns for temporary storage. Due to the singler stop no further bank notes reach stacker 50.

Stacked unit 120 of bank notes can now be emptied from stacking pocket 53 e.g. by means of a suitably formed gripper not shown here. Alternatively, stacking pocket 53 including stacked unit 120 of bank notes can also be replaced by another empty stacking pocket not shown. It is also possible to perform a further-processing operation, such as banding of the stacked unit, in the stacker and then empty the banded unit from stacking pocket 53.

Singler 10 is reactivated at a suitable time by control device 60, so that next bank note 103 reaches stacking wheel 51 in such a way as to be introduced into the pocket following the pocket of bank note 102 if possible. FIG. 2D shows how stripper 52 is moved back into the working position in stacking wheel 51 without influencing the bank notes in stacking wheel 51. Temporarily stored bank notes 101 and 102 are then stripped out by stripper 52 into emptied stacking pocket 53, and following bank note 103 reaches stacker 50. Stacker 50 is now in normal stacking operation again.

Stripper 52 can be moved in and out for example by a stepping motor or linear drive 104 as shown in FIG. 2D. FIG. 3 shows a further possibility consisting in the use of contour disk 54. This disk is fastened to an axle with stacking wheel 51. Contour disk 54 has guide grooves 55 adapted in shape to the course of the pockets of stacking wheel 51. For moving out stripper 52, bolt 56 is introduced through corresponding guide groove 55 into a specially provided opening on the upper side of stripper 52. This can be done e.g. by means of a lifting magnet not shown here. The turning of stacking wheel 51 including contour disk 54 causes bolt 56 to be guided along guide groove 55. The rigid link between stripper 52 and bolt 56 causes stripper 52 to be moved out of stacking wheel 51. For moving stripper 52 in, bolt 56 is pulled out of the opening of stripper 52 so that the latter is moved back to its working position in stacking wheel 51 e.g. by a spring not shown here. One advantage of this embodiment is that the relatively elaborate control means for a stepping motor or linear drive can be dispensed with.

To obtain a high throughput in the bank note processing machine the free parameters of the stacker, such as the number of stacking pockets and the control of the individual components, are optimized so as to keep the singling gap as short as possible. For this purpose stacking wheel 51 can e.g. be accelerated for a short time for at least part of its rotation after receiving bank note 102, so that the bank notes can be stripped out more quickly and the wait for a turn of stacking wheel 51 can be reduced. Stripper 52 can thus be moved into stacking wheel 51 earlier and stacker 50 is thus ready to receive following bank note 103 earlier.

The number of bank notes to be stored temporarily depends on the length of transport path 30 between singler 10 and sensor device 20. The exact moments for stopping and activating the singler result substantially from the dimensions of transport path 30 and the transport speed of the bank notes.

In a further embodiment, temporary store 40 is not integrated in stacker 50 but incorporated in transport path 30 as separate buffer path 80. FIG. 4 shows a schematic diagram of buffer path 80. It includes switch 81 for guiding the bank notes out of transport path 30 for temporary storage. They then pass via transport path 82 into self-contained transport path 83 in which they are stored temporarily. The number of bank notes in the temporary store is determined substantially by the length of transport path 83, and the duration of temporary storage by the number of circulations of the bank notes in transport path 83. When buffer unit 80 receives from control device 60 the command to empty the bank notes, the bank notes beginning with note 101 are diverted by means of switch 84 out of transport path 83 into transport path 85, to pass from there back into transport path 30 and then further into stacker 50.

This embodiment has the advantage that it does not demand certain properties of stacker 50, so that stacker 50 need not have special components and can be designed in any way desired.

Furthermore this embodiment dan be mounted at any desired place in transport path 30, e.g. directly behind the sensor device. This makes it possible for both bank notes intended for stacker 50 and bank notes intended for other further-processing units to be stored temporarily in just one buffer path.

I claim:

1. A method for processing a plurality of sheets of material, each of said sheets exhibiting a characteristic which may differ among the sheets, said method forming at least one stack of a predetermined number of sheets having a selected characteristic, said method comprising the steps of:

singling the sheets;

transferring the singled sheets to a first end of a transport path and moving the sheets in seriatim along the transport path;

testing the sheets in the transport path for the selected characteristic;

continuing the movement of sheets having the selected characteristic in the transport path toward a second end of said transport path at which the stack is to be formed;

removing said sheets from the transport path and forming a stack of the sheets;

counting the number of sheets having the selected characteristic as they move along the transport path;

interrupting the transferring of the sheets to the transport path when the last sheet of the predetermined number of sheets for the stack has been counted;

after the interruption, sorting sheets that are following the last sheet in the transport path; and thereafter discharging the stored sheets to form a new stack of sheets.

2. The method of claim 1 wherein the step of storing the sheets is further defined as separately storing each of the sheets following the last sheet.

3. The method of claim 2 wherein the step of storing the sheets is further defined as storing the sheets in a stacking device used to form the stack of sheets having the selected characteristics.

4. The method of claim 3 wherein the method is further defined as:

storing the sheets in spirally disposed pockets of a rotating stacking wheel, said stacking wheel having a stripper movable into and out of said stacking wheel for removing sheets from the pockets;

moving the stripper out of the stacking wheel so that the sheets stored in the pockets remain in the wheel for at least one turn of the rotating stacking wheel;

moving the stripper into the stacking wheel; and stripping the stored sheets out of the stacking wheel with the stripper for forming the new stack of sheets.

5. The method of claim 4 further defined as increasing the rotational speed of the rotating stacking wheel after the sheets have been stored in the pockets to shorten the period of time during which the stacking wheel performs the at least one turn and to advance the time at which the stripper may be moved into the stacking wheel for stripping the stored sheets out of the stacking wheel.

6. The method of claim 1 wherein the step of storing the sheets is further defined as diverting the sheets following the last sheet from the transport path and thereafter discharging the stored sheets to form a new stack of sheets.

7. The method according to claim 6 further defined as:

diverting the sheets following the last sheet to a circulating transport path;

storing the diverted sheets for at least one circulation of the circulating transport path; and discharging the diverted sheets from the circulating transport path to the first mentioned transport path.

8. An apparatus for processing a plurality of sheets of material, each of said sheets exhibiting a characteristic which may differ among the sheets, said apparatus forming at least one stack of a predetermined number of sheets having a selected characteristic, said apparatus comprising:

a singling unit for singling the sheets;

transport means having a first end for receiving the singled sheets, said transport means having a transport path along which the sheets are moved in seriatim;

sensor means located along the transport path formed in said transport means for testing the sheets moving in the transport path for the selected characteristic;

means for counting the number of sheets having the selected characteristic as they move along the transport path;

a stacker device proximate to a second end of said transport means for receiving sheets having the selected characteristic from said transport path and for forming a stack of the sheets;

means for interrupting the transfer of sheets to said transport means when the last sheet of the predetermined number of sheets for the stack has been counted; and means for storing the sheets that are following the last sheet in the transport path as separate sheets while said stacking device completes the formation of the stack of sheets and for thereafter discharging the stored sheets to said stacking device for forming a new stack of sheets.

9. The apparatus of claim 8 further including a rotatable stacking wheel with a plurality of spirally disposed pockets for receiving the sheets to be stored, said stacking wheel having a stripper movable into and out of the stacking wheel for stripping the stored sheets from the spirally disposed pockets to discharge the stored sheets.

10. The apparatus of claim 9 further including a linear motor coupled to said stripper for moving said stripper.

11. The apparatus of claim 9 further including a stepper motor coupled to said stripper for moving said stripper.

12. The apparatus of claim 9 wherein said stripper is coupled to said stacking wheel by a cam and follower mechanism for moving said stripper responsive to rotation of said stacking wheel.

13. The apparatus of claim 8 wherein said storage means comprises a circulating transport means having a circulating path for moving sheets in seriatim; and diversion means interposed between said first mentioned transport means and said circulating transport means for diverting the sheets following the last sheet from said first mentioned transport means to said circulating transport means for storing the sheets in said circulating transport means, said diversion means discharging the stored sheets from said circulating transport means for supply to said stacking device.

* * * * *